US007673593B2

(12) United States Patent
Justin

(10) Patent No.: US 7,673,593 B2
(45) Date of Patent: Mar. 9, 2010

(54) ENGINE COOLING SYSTEM

(75) Inventor: Thomas Justin, Brignais (FR)

(73) Assignee: Renault Trucks, Saint Priest (FR)

( * ) Notice: Subject to any disclaimer, the term of this patent is extended or adjusted under 35 U.S.C. 154(b) by 27 days.

(21) Appl. No.: 11/722,544

(22) PCT Filed: Dec. 24, 2004

(86) PCT No.: PCT/IB2004/004393

§ 371 (c)(1),
(2), (4) Date: Jun. 22, 2007

(87) PCT Pub. No.: WO2006/067553

PCT Pub. Date: Jun. 29, 2006

(65) Prior Publication Data

US 2008/0127913 A1 Jun. 5, 2008

(51) Int. Cl.
*F01P 11/08* (2006.01)
*F01P 3/22* (2006.01)
*F01P 9/00* (2006.01)

(52) U.S. Cl. ..... 123/41.33

(58) Field of Classification Search ..... 123/41.31, 123/41.09, 41.1, 41.33, 41.51, 41.54, 41.2
See application file for complete search history.

(56) References Cited

U.S. PATENT DOCUMENTS 2,404,778 A * 7/1946 Allison ..... 422/186.11
3,001,379 A * 9/1961 Fukuzawa et al. ..... 62/196.1
3,162,183 A * 12/1964 Gratzmuller ..... 123/41.08
5,443,114 A 8/1995 Deary et al.
6,732,678 B2 * 5/2004 Lin et al. ..... 123/25 R
7,048,044 B2 * 5/2006 Ban et al. ..... 165/202
2003/0230251 A1 * 12/2003 Chang et al. ..... 123/41.54
2003/0230252 A1 * 12/2003 Lin et al. ..... 123/41.54

FOREIGN PATENT DOCUMENTS

GB 2270375 A 3/1994
JP 58214612 A 12/1983
JP 61083434 A 4/1986
JP 11257075 A 9/1999

* cited by examiner

*Primary Examiner*—Hai H Huynh
(74) *Attorney, Agent, or Firm*—Novak Druce + Quigg, LLP

(57) ABSTRACT

The invention concerns an engine cooling system that comprises a cooling circuit (8) and an evaporative cooling arrangement (9). The cooling circuit (8) has a cooling capacity provided by exchanging the heat generated by the engine with ambient air. The evaporative cooling arrangement (9) has a cooling capacity provided by dissipating the heat generated by the engine, by vaporization of a vaporizing coolant in a boiler. The cooling capacity of the evaporative cooling arrangement (9) is such that with the cooling capacity of the cooling circuit (8), the global capacity of the cooling system can match, at least peak, cooling demands. As the cooling capacity of the cooling system is divided between the capacity of the cooling circuit and the capacity of the evaporative cooling arrangement, the capacity of the cooling circuit can be reduced in comparison to a conventional cooling circuit which has to match alone peak cooling demands.

27 Claims, 2 Drawing Sheets

ENGINE COOLING SYSTEM

FIELD OF THE INVENTION

The present invention concerns a cooling system for an engine.

BACKGROUND OF THE INVENTION

A combustion engine in a vehicle produces mechanical energy in the form of work which is used to move the vehicle and thermal energy in the form of heat. Excess of heat generated by the engine has to be removed so that the engine is maintained at a constant temperature. To this end, a combustion engine is equipped with a cooling circuit which uses the ambient air to remove the excess of heat produced by the engine.

There is a demand for cooling circuits of increased capacity because of a trend to equip vehicles and especially but not only, industrial vehicles with more powerful and therefore bigger engines. Bigger engines are required to move heavier vehicles and to power additional components such as air conditioning systems, hydraulic devices, alternators for electric equipments etc. Additionally, some vehicles are equipped with pollution control devices such as exhaust gas recycling devices which can have the effect of increasing the heat generated by the engine.

The consequence is that conventional cooling circuits which can include heat exchangers for cooling engine fluids (water, oil or supercharged air), fans and/or pumps have to be dimensioned to remove the heat of currently used big size engines and therefore must be of a substantial size.

This has a considerable impact on the architecture of the vehicle as the vehicle has to be designed to accommodate large cooling packages.

In the case of an industrial vehicle such as a lorry, this means that the vehicle might be taller than desired which is detrimental to aerodynamic drag or to comfort of the vehicle as the cabin has to be higher than desired.

An important point is that the cooling circuit of a vehicle is dimensioned to be effective in a combination of worst case conditions, that is to say conditions combining high ambient temperature, severe route conditions, severe driving conditions and/or high engine load. This is based on the principle that if the cooling circuit is dimensioned to face the worst possible conditions it can therefore operate satisfactorily in any conditions encountered by the vehicle.

It has therefore appeared that there is room to improve the general thermal management of a cooling system in a motorized vehicle.

SUMMARY OF THE INVENTION

One object of the invention is decrease the capacity of a cooling circuit which dissipates the heat generated by an engine.

Another object of the invention is to propose an autonomous engine cooling system having a cooling circuit of reduced capacity.

The invention concerns an engine cooling system that comprises a cooling circuit and an evaporative cooling arrangement. The cooling circuit has a cooling capacity provided by exchanging the heat generated by the engine with ambient air. The evaporative cooling arrangement has a cooling capacity provided by dissipating the heat generated by the engine, by vaporisation of a vaporising coolant in a boiler. The cooling capacity of the evaporative cooling arrangement is such that with the cooling capacity of the cooling circuit, the global capacity of the cooling system can match at least peak cooling demands.

An engine can operate under various environment, load or operation types. The consequence is that the heat load dissipated by the engine may vary considerably therefore putting different demands on the cooling system.

Thus, the cooling system may face normal conditions where the cooling system has to cope with normal cooling demands. Normal conditions and, therefore normal cooling demands, are the engine most common operative conditions. Typically, in the case of a motorized vehicle, normal conditions can mean that the vehicle operates under standard temperature conditions and/or operates with a regular load and/or operates on routes of average gradients and/or operates in normal traffic with a sufficient speed to provide an air flow to dissipate engine heat. The cooling system has mostly to face normal cooling demands.

However, the cooling system may also face worst case conditions where the cooling system has to cope with peak cooling demands. Worst case conditions and, therefore, peak cooling demands occur rarely in an engine operative life. Typically, in the case of a motorized vehicle worst case conditions may occur in one or a combination of the following conditions: high ambient temperature (for example: summer months in the northern hemisphere) and/or severe route conditions (for example: steep road) and/or severe driving conditions (for example: heavy traffic where periods of slow motion alternate with periods of standstill) and/or high load (for example: a lorry carrying a heavy load).

According to the invention, the cooling system is divided between a cooling circuit and an evaporative cooling arrangement which together have a global cooling capacity capable of matching at least peak cooling demands. The cooling system has the cooling resources to cope with any kind of conditions and especially can face worst case conditions. As the cooling capacity of the cooling system is divided between the capacity of the cooling circuit and the capacity of the evaporative cooling arrangement, the capacity of the cooling circuit can be reduced in comparison to a conventional cooling system where the cooling capacity is entirely provided by its cooling circuit. In other words, the cooling circuit can be under dimensioned to face, alone, peak cooling demands. This is of great benefit for the architecture of the vehicle in so far as the cooling circuit can be more compact in comparison to a conventional cooling circuit. When facing peak cooling demands, an additional cooling resource is provided by the evaporative cooling arrangement which uses the cooling power of the latent heat of a fluid phase change. A very important point of the invention lays in the use of a boiler which provides an efficient vaporisation that is to say an optimum use of the latent heat of the vaporising coolant. A boiler offers a further advantage of making a clean use of the vaporising coolant insofar as the additional coolant is not sprayed directly onto a mechanical component with a risk of soiling the component or creating a thermal stress in the component. Instead the vaporising coolant is vaporised when needed in a boiler, thus, dissipating the excess of heat generated by the engine in worst case conditions.

Preferably, the cooling circuit is suitably dimensioned to have a cooling capacity capable of matching at least normal cooling demands and the evaporative cooling arrangement is suitably dimensioned to have a capacity equal to at least the difference between peak cooling demands and normal cooling demands. In this embodiment of the invention, under normal operative conditions i.e. most common operative conditions, the cooling circuit having a capacity to match at least normal cooling demands, can cope alone with the engine cooling needs. This means that under normal conditions, the evaporative cooling arrangement is not needed and, therefore, is not working. when the engine operates under worst case conditions putting cooling peak demands on the cooling system, the evaporative cooling arrangement start working. The evaporative cooling arrangement can then dissipate the excess of heat load occurring during worst case conditions.

In a preferred embodiment of the invention, vaporising coolant can be liquid water which is widely available and stores a significant latent heat.

Preferably, the vaporising coolant can be liquid water collected from an evaporator of an air conditioning unit. This has the great advantage of making the cooling system totally autonomous. The cooling system according to the invention stores cooling capacity in the form of liquid water produced by the air conditioning unit. In the case of the invention, this condensate water is regarded as cooling energy whereas it is normally wasted. When needed by the occurrence of peak cooling demands, this additional cooling capacity i.e. condensate water is used in its most efficient way which is through a change of phase.

The evaporative cooling arrangement can operate in an open loop mode. The vaporised water is preferably released in the ambient air. Condensing vaporised water coming out of the boiler for a further use is possible but would require some substantial equipment and energy and is therefore not desired in most embodiments of the invention.

Advantageously the boiler is equipped with a steam separator that is to say a device for removing remaining liquid water from steam and ultimately obtaining dry steam from the boiler, increasing therefore the efficiency of the vaporisation as the evaporative fluid undergoes a complete change of phase. Thus the latent energy stored in the evaporative coolant is entirely released.

To reduce wet steam, it is also envisaged that the boiler can have means for achieving a superheating of the evaporative coolant. Superheating the evaporative coolant by 5 to 10° C. above normal change of phase conditions allows a recovery close to 100% of the latent heat stored the evaporative coolant.

In a possible embodiment of the invention, the evaporative cooling arrangement, in peak cooling demands, cools an engine cooling fluid by a change of phase of the vaporising coolant in the boiler from liquid to gas caused by the exchange of heat between said engine cooling fluid and the vaporising coolant.

Although various heat sources such as internal and external engine hot parts may be cooled by the evaporative cooling arrangement, it is specifically advantageous to use the additional cooling capacity to cool an engine cooling fluid in peak cooling conditions.

Because cooling fluids have high convection properties, the boiler and the connection pipes of the boiler can be compact. This is an important advantage as one object of the invention is to improve the general architecture of a vehicle.

Another reason is that cooling fluids have a significant thermal inertia. The occurrence of critical temperature for cooling fluids is therefore rare thus limiting the use of the additional cooling capacity.

In a preferred embodiment, the evaporative cooling arrangement is connected to a cooling and lubricating circuit whose oil, in peak working conditions, is cooled by a change of phase of the vaporising coolant in the boiler from liquid to gas caused by the exchange of heat between the oil and the vaporising coolant.

A reason for cooling the engine oil is that as the maximum temperature of the engine oil can reach approximately 125° C. in worst case conditions and as the vaporising temperature of water in standard pressure conditions is 100° C., this sort of temperature difference would lead to stable boiling conditions in the boiler. Moreover, allocating the extra cooling capacity to the oil has the advantageous effect of eliminating oil temperature peaks.

In this embodiment of the invention, the cooling system can comprise an oil cooler downstream of the boiler. The boiler can be connected to the oil circuit to convey heat charged oil in the boiler.

Advantageously, a collector can be located adjacent to the evaporator of the air conditioning unit to receive condensate water from the evaporator during operation of the air conditioning unit.

In a preferred embodiment, the cooling system can comprise a tank where the evaporative coolant can be stored for a potential use, should there be peak demands on the cooling system.

The tank can have an inlet port connected to the collector and an outlet port connected to the boiler.

The cooling system suitably comprises a dosing unit controlling the quantity of evaporative coolant injected in the boiler as the evaporative coolant is conveyed into the boiler during peak demands on the cooling system.

The cooling system can comprise a boiler bypass valve capable of regulating the flow of oil in the boiler and can also comprise an oil cooler bypass valve capable of regulating the flow of oil in the cooler.

In a preferred embodiment, the cooling system can comprise an electronic control unit that controls the operation of the boiler.

Preferably, the electronic control unit can control the flow of evaporative coolant going into the boiler.

To determine whether the engine is facing normal cooling demands or peak cooling demands, the electronic control unit can be fed with data regarding cooling fluid temperature or oil temperature.

To convey the steam released by the boiler, a chimney can be positioned downstream of the boiler. Thanks to the chimney, the steam high temperature steam can be disposed safely.

BRIEF DESCRIPTION OF THE DRAWINGS

The following detailed description of the invention is better understood when read in conjunction with the appended drawings being understood, however, that the invention is not limited to the specific embodiments disclosed. In the drawings.

Similar numeral references denote corresponding features thoughout the attached drawings.

DETAILED DESCRIPTION OF THE INVENTION

Figure 1:
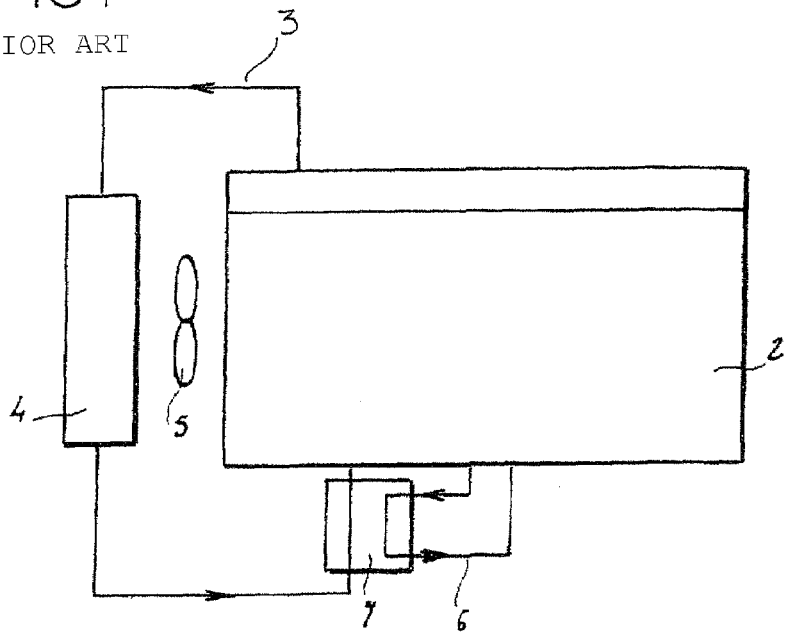
FIG 1 PRIOR ART
FIG. 1 is a diagrammatic view of an internal combustion engine equipped with a conventional cooling circuit.

FIG. 1 shows in a schematic way an engine equipped with a conventional cooling circuit 3. This engine can power any type of vehicle or equipment. The engine 2 generates energy in the form of heat. Heat can be dissipated through the cooling circuit 3, in which a cooling fluid generally water based circulates around hot parts of engine 2 (cylinder heads and cylinder sleeves). Cooling fluid coming out of the engine at a high temperature is cooled in a radiator 4 by ambient air flowing through the radiator 4. The cooling circuit 3 can also include a pump (not shown) that moves the heat charged cooling fluid from the engine into the radiator 4.

A fan 5 is usually used, to increase the flow of ambient air going through the radiator 4 according to the cooling needs of the engine 2.

Heat in an oil circuit 6 of the engine can also be dissipated. To this end, the engine is suitably equipped with an oil cooler 7. In the oil cooler 7, oil at a high temperature coming from the engine 2 is cooled by the cooling fluid of the cooling circuit 3 and then returns to the engine 2 at a lower temperature.

As this is clear from FIG. 1, the cooling capacity of the cooling circuit 3 that is to say, its power of dissipating heat is set by the capacity of the radiator 4, of the fan 5 and of the pump. The whole cooling circuit 3 must be dimensioned to face worst case conditions, for example: high ambient temperature (for example: summer months in the northern hemisphere) and/or severe route conditions (for example: steep road) and/or severe driving conditions (for example: heavy traffic where periods of slow motion alternate with periods of standstill) and/or high load (for example: a lorry carrying a heavy load). These worst case conditions generate peak demands on the cooling system 3 as during these worst case conditions the engine has to dissipate a substantial amount of heat.

Worst case conditions (and consequently peak demands on the cooling circuit 3) occur rarely and are marginal in the operational life of a vehicle. However the cooling circuit 3 has to be designed and dimensioned to remove the heat generated by the engine under these worst case conditions. Therefore, the cooling circuit 3 and especially the radiator 4 will most likely be over dimensioned in relation to the cooling demands when the engine operates under normal conditions. These normal conditions occur during most of the operational life of the engine.

In some cases, fitting in a vehicle a cooling circuit 3 of large capacity and especially a large radiator 4 can be detrimental to some important features of the vehicle such as its aerodynamic drag, bearing in mind that the entire cooling capacity of the cooling circuit 3 will most likely very rarely be used.

Figure 2:
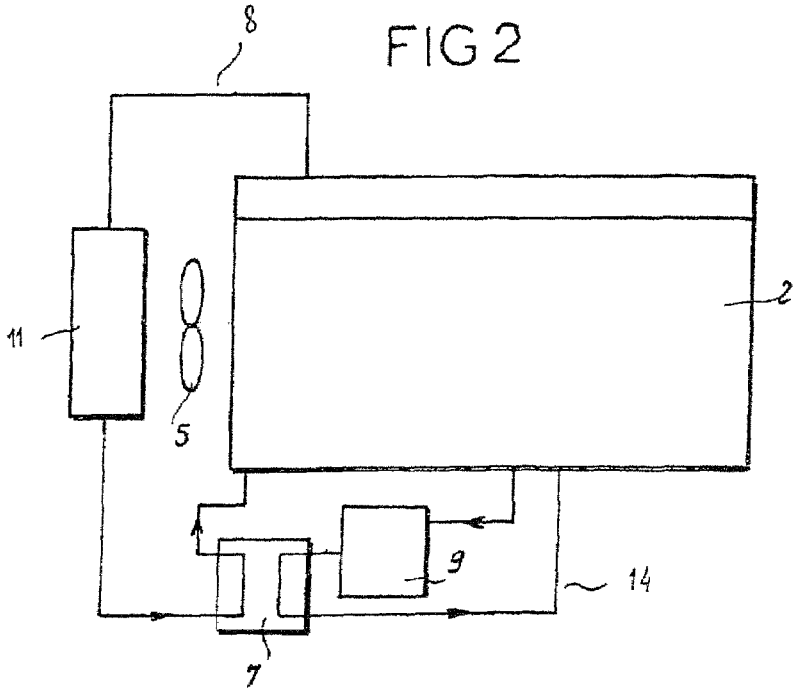
FIG. 2 is a diagrammatic view of an internal combustion engine equipped with an embodiment of a cooling system according to the invention.

FIG. 2 illustrates an embodiment of the invention whereby an engine is equipped with a cooling system having a cooling circuit 8 dimensioned to face normal cooling demands and having an evaporative cooling arrangement 9. The evaporative cooling arrangement 9 is used in peak demands on the cooling circuit 8 to dissipate an excess of heat load occurring during worst case conditions.

In the illustrated example, the excess of heat load located in a lubricant of a lubricant circuit 14 is dissipated in the evaporative cooling arrangement 9. Such an arrangement can be advantageous for reason that will be explained below but the evaporative cooling arrangement 9 can also dissipate heat generated by other components of the engine.

As shown in FIG. 2, the evaporative cooling arrangement 9 is interposed between the engine 2 and an oil coolant 7. The cooling circuit 8 can have a radiator 11 together with a fan 5 and a pump (not illustrated). The cooling circuit 8 and especially the radiator 11 is suitably dimensioned to cope with normal cooling demands, which occur most of time in the operational life of a vehicle. The cooling circuit 8 includes a radiator 11 of such a size that together with the evaporative cooling arrangement 9 it can cope with the peak cooling demands.

Figure 3:
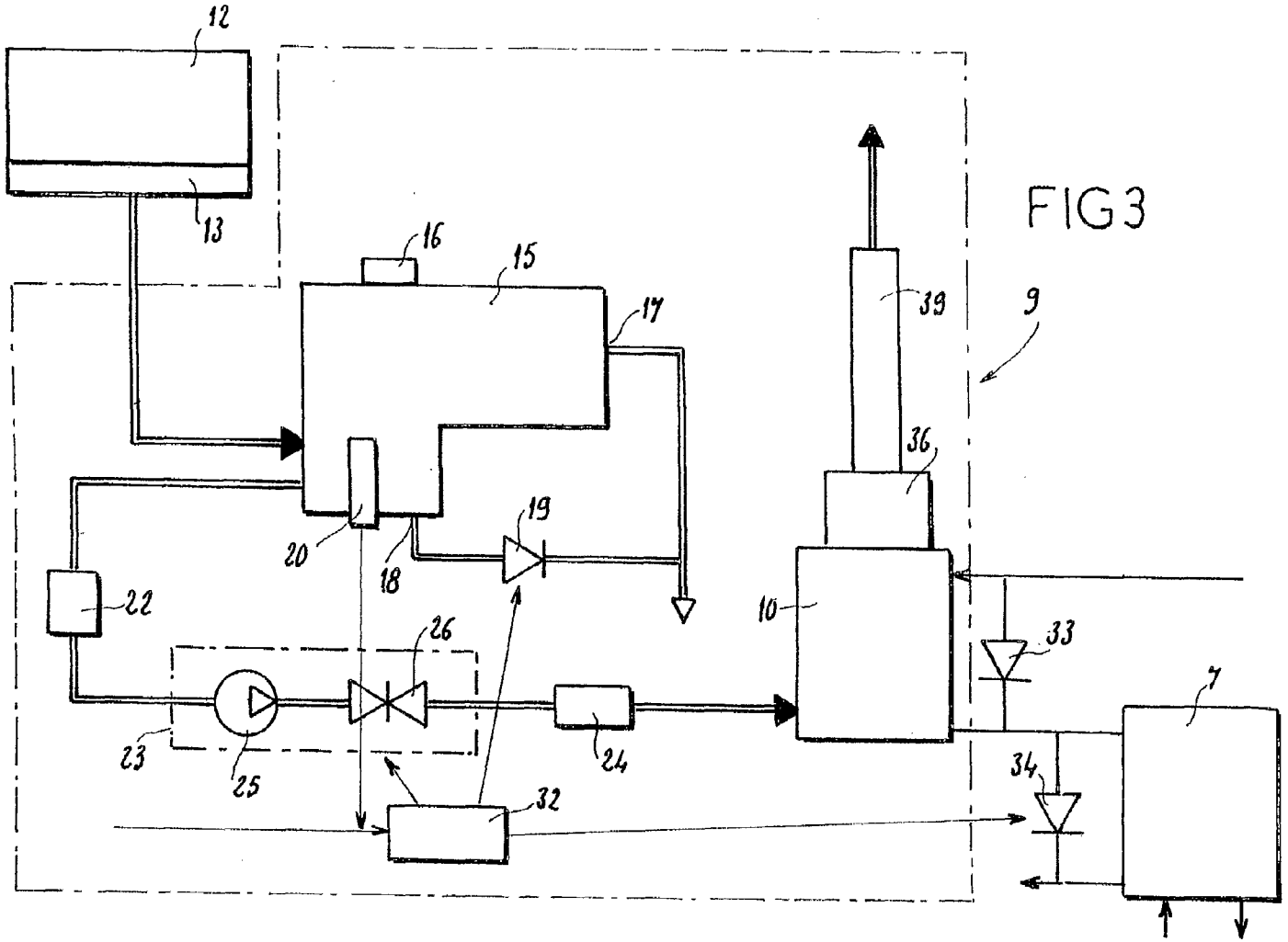
FIG. 3 is a diagrammatic view of an evaporative cooling arrangement part of the cooling system of FIG. 2.

Referring to FIG. 3, the exemplified evaporative cooling arrangement 9 is carried out with a boiler 10 which is connected to a recovery water system, the connections of which are illustrated with double lines, and to an engine oil circuit, the connections of which are illustrated with single lines.

As far as the water recovery system is concerned, condensate water is formed in an evaporator 12 of an air conditioning unit of a standard type which is not described further. Condensate water is usually released and wasted.

In the case of the invention, condensate water can be received in a collector 13 as shown on FIG. 3. The collector 13 is linked to a tank 15 where condensate water can be stored. Tank 15 is suitably equipped with a cap 16, an overflow port 17, a draining port 18 controlled by a valve 19. Furthermore, the tank 15 can have a level sensor 20.

The tank 15 is suitably connected to the boiler 10. Condensate water flowing from the tank 15 to the boiler 10 can be filtered in a pre filter 22 and a filter 24 and therefore condensate water arrives at the boiler 10 in a state of great cleanness. The flow of condensate water conveyed from the tank 15 in the boiler 10 can be controlled by a dosing unit 23 which can comprise, for example, a pump 25 and a valve 26.

As far as the oil circuit 14 is concerned, the oil circuit 14 can convey oil from the engine 2 into the boiler 10 and to the oil cooler 7 As illustrated the boiler 10 can be fitted with a bypass valve 33 capable of regulating the flow of oil in the boiler 10 and the oil cooler 7 is also suitably equipped with a bypass valve 34 capable of regulating the flow of oil in the cooler 7.

An electronic control unit 32 controls the flow of condensate water going through the dosing unit 23 and valve 19. The electronic control unit 32 controls also bypass valves 33 and 34. The electronic control unit 32 is furthermore informed of the level of condensate water stored in the tank 15 as level sensor 20 is linked to the electronic control unit 32. The electronics control unit 32 can receive data regarding coolant temperature and oil temperature. Should the temperature of the coolant and/or of the oil exceed a respectively set value, the cooling circuit 8 cannot cope alone with such cooling demands. The specific values of the coolant and the oil under normal cooling demands or under peak cooling demands may vary according to the engine, to the application of a vehicle powered by said engine or by the condition of use of said vehicle. The essential functions of the electronic control unit 32 will appear below.

When the engine operates under normal conditions (for example when the electronic control unit 32 receives coolant or oil temperature data being under a preset value), the evaporative cooling arrangement 9 is not activated as the cooling circuit 8 especially the radiator 4 and the fan 5 are dimensioned to satisfactorily cool the engine 2. Should the engine operate under such conditions, the electronic control unit 32 can order the bypass valve 33 to divert the oil from the boiler 10. In this mode of operation, the engine operates substantially as the engine of FIG. 1 with however the significant difference in term of vehicle architecture that the cooling circuit 8 is of smaller capacity which is suitably achieved by the radiator 11 being of smaller capacity and in particular of smaller size in comparison to the radiator 4 of the conventional cooling circuit 3. When operating under normal condition and provided an air conditioning unit is switched on, or automatically switched on due to low level of condensate water in the tank 15, condensate water is collected and stored in the tank 15. It is estimated that an average quantity of 0.015 l/min of condensate water can be collected in the case of an air conditioning unit dimensioned to cool a lorry cabin. The quantity of condensate water varies considerably with the type of vehicles; for example a coach or a bus which has an air conditioning unit designed to cool a large cabin would produce far more condensate water. It may also vary according to the air humidity.

When the engine operates under worst case conditions (for example when the electronic control unit 32 receives coolant or oil temperature data being above a preset values) and therefore the demands on the cooling system are extreme, the cooling circuit 8 alone cannot match such demands. The electronic control unit 32 can order the dosing unit 23 to convey condensate water stored in the tank 15 into the boiler 10. In the boiler 10, the oil coming from the engine 2 can be at a temperature of approximately 125° C.; water coming from the tank 15 changes of phase thus dissipating heat from the oil.

It is specifically advantageous to use the additional cooling capacity of the evaporative cooling arrangement 9 to cool an engine cooling fluid such as the engine oil in peak cooling conditions. As oil has high convection properties, the boiler and the connection pipes of the boiler can be compact. Another reason is that oil has a significant thermal inertia. The occurrence of critical temperature for cooling fluids and especially for oil is therefore rare thus limiting the use of evaporative cooling arrangement 9. A further advantage for cooling the engine oil is that as the maximum temperature of the engine oil can be approximately 125° C. in worst case conditions and as the vaporising temperature of water in standard pressure conditions is 100° C., this sort of temperature difference would lead to stable boiling conditions in the boiler 10. Moreover, using the evaporative cooling arrangement 9 to cool the engine oil when cooling peak demands occur has the advantageous effect of eliminating oil temperature peaks.

It could be noted that the boiler 10 can be equipped with a steam separator 36 that is to say a device for removing non vaporised water from steam and ultimately obtaining dry steam from the boiler 10. The steam separator 36 can therefore increase the efficiency of the vaporisation as the condensate water undergoes a complete change of phase. Thus the latent energy stored in the evaporative fluid is entirely released in the cooling process of the oil.

On average, a quantity of 0.32 l/min of water can be vaporized in the boiler 10 when the engine operates in worst case conditions creating peak demands on the cooling system. In the case of a lorry; it is estimated that an average additional power of 12 kW can be released. The boiler 10 rejects a flow of steam into the ambient air caused by the change of phase of the water whereas the oil coming out of the boiler is at a lower temperature. The flow of steam is suitably extracted through a chimney 39 which conveys the high temperature steam to a point where it can be safely released. The electronic control unit 32 can order the valve 34 to bypass the cooler 7, thereby returning the oil coming out of the boiler 10 directly to the engine 2.

The electronic control unit 32 can also control the level of the condensate water in the tank 15 through valve 19. Specifically, it can order periodic draining of the tank 15 to avoid formation of mould or algae. It can also order complete or partial draining of the tank 15 in case of freezing temperature to avoid any damage of the tank 15 when, furthermore, additional cooling capacity is not likely to be needed.

As it can be drawn from the above description, first of all the invention provides a cooling system which can cope with worst case conditions by a cooling circuit which is under dimensioned to face alone peak cooling demands and an additional evaporative cooling which rely when needed on the high latent heat of a fluid change of phase.

Secondly, the invention provides an autonomous cooling system whereby the fluid, whose latent heat is used, is water collected from an air conditioning unit. An air conditioning unit generates water during its operation; this water is stored and then used when needed as a cooling source.

Naturally, the invention is not limited to the embodiment described above as non-limiting example, but on the contrary it embraces all the embodiments and modifications within the scope of the appended claims. The invention can be implemented in any kind of vehicle powered by an internal combustion engine. Although the invention has some considerable benefits when implemented on industrial vehicles especially buses and coaches, it can of course be implemented in railway, agricultural or private vehicles.

The invention can also be implemented on fixed installations such as an electric generating set having an engine and an air conditioning unit.

The invention claimed is:

1. A cooling system for an engine (2) comprising:

a cooling circuit (8) having a cooling capacity provided by exchanging the heat generated by the engine (2) with ambient air, and an evaporative cooling arrangement (9) having a cooling capacity provided by dissipating the heat generated by the engine (2) by vaporization of a vaporizing coolant in a boiler (10), wherein the evaporative cooling arrangement (9) is connected in heat-transferring relationship to a cooling and lubricating circuit (14) containing oil which, under peak cooling demands, is cooled by a change of phase of the vaporizing coolant in the boiler (10) from liquid to gas caused by the exchange of heat between the oil and the vaporizing coolant.

2. The cooling system as recited in claim 1, further comprising an oil cooler (7) located downstream of the boiler (10).

3. The cooling system as recited in claim 1, further comprising a boiler bypass valve (33) capable of regulating the flow of oil going in the boiler (10).

4. The cooling system as recited in claim 2, further comprising an oil cooler bypass valve (34) capable of regulating the flow of oil going in the cooler (7).

5. The cooling system as recited in claim 1, wherein the evaporative cooling arrangement (9) operates in an open loop mode.

6. The cooling system as recited in claim 1, wherein the boiler (10) is equipped with a steam separator (36).

7. The cooling system as recited in claim 1, wherein the boiler (10) has means for achieving a superheating of the evaporative coolant.

8. The cooling system as recited in claim 1, further comprising a chimney (39) positioned downstream of the boiler (10).

9. A cooling system for an engine (2) comprising:

a cooling circuit (8) having a cooling capacity provided by exchanging the heat generated by the engine (2) with ambient air, and an evaporative cooling arrangement (9) having a cooling capacity provided by dissipating the heat generated by the engine (2) by vaporization of a vaporizing coolant in a boiler (10), wherein the vaporizing coolant is liquid water collected during an air cooling operation of an air conditioning unit.

10. The cooling system as recited in claim 9, wherein the liquid water is collected from an evaporator (12) of an air conditioning unit.

11. The cooling system as recited in claim 10, further comprising a collector (13) located adjacent to the evaporator (12) of the air conditioning unit to receive condensate water from the evaporator (12) while the air conditioning unit is in operation.

12. The cooling system as recited in claim 9, further comprising a tank (15) where the evaporative coolant is stored.

13. The cooling system as recited in claim 12, wherein the tank (15) has an inlet port connected to the collector (13) and an outlet port connected to the boiler (10).

14. The cooling system as recited in claim 12, further comprising a dosing unit (23) controlling the quantity of evaporative coolant injected in the boiler.

15. The cooling system as recited in claim 14, further comprising an electronic control unit (32) that controls the operation of the boiler (10), the electronic control (32) unit controlling the flow of evaporative coolant going into the boiler (10).

16. The cooling system as recited in claim 14, wherein the evaporative cooling arrangement (9), under peak cooling demands, cools an engine cooling fluid by a change of phase of the vaporizing coolant in the boiler (10) from liquid to gas caused by the exchange of heat between said engine cooling fluid and the vaporizing coolant.

17. The cooling system as recited in claim 9, wherein the evaporative cooling arrangement (9) operates in an open loop mode.

18. The cooling system as recited in claim 9, wherein the boiler (10) is equipped with a steam separator (36).

19. The cooling system as recited in claim 9, wherein the boiler (10) has means for achieving a superheating of the evaporative coolant.

20. The cooling system as recited in claim 9, further comprising a chimney (39) positioned downstream of the boiler (10).

21. A cooling system for an engine (2) comprising:

a cooling circuit (8) having a cooling capacity provided by exchanging the heat generated by the engine (2) with ambient air, and an evaporative cooling arrangement (9) having a cooling capacity provided by dissipating the heat generated by the engine (2) by vaporization of a vaporizing coolant in a boiler (10), wherein the evaporative cooling arrangement (9) is connected to a cooling and lubricating circuit (14) containing oil which, under peak cooling demands, is cooled by a change of phase of the vaporizing coolant in the boiler (10) from liquid to gas caused by the exchange of heat between the oil and the vaporizing coolant, and wherein the vaporizing coolant is liquid water collected during an air cooling operation of an air conditioning unit.

22. The cooling system as recited in claim 21, further comprising a tank (15) where the evaporative coolant is stored and a dosing unit (23) that controls the quantity of evaporative coolant injected in the boiler.

23. The cooling system as recited in claim 22, further comprising an electronic control unit (32) that controls the operation of the boiler (10), wherein the electronic control unit (32) controls the flow of evaporative coolant going into the boiler (10) and is provided with data regarding cooling fluid temperature or oil temperature.

24. The cooling system as recited in claim 21, wherein the evaporative cooling arrangement (9) operates in an open loop mode.

25. The cooling system as recited in claim 21, wherein the boiler (10) is equipped with a steam separator (36).

26. The cooling system as recited in claim 21, wherein the boiler (10) has means for achieving a superheating of the evaporative coolant.

27. The cooling system as recited in claim 21, further comprising a chimney (39) positioned downstream of the boiler (10).

* * * * *